US005680958A

United States Patent [19]

Mann et al.

[11] Patent Number: 5,680,958

[45] Date of Patent: Oct. 28, 1997

[54] BOTTLE/CONTAINER HOLDER FOR TRANSPORTING THE BOTTLE/CONTAINER

[76] Inventors: Howard Mann, 6904 Mill Falls Dr., Dallas, Tex. 75248; J. Stanley Fredrick, 3509 Wingren, Irving, Tex. 75062

[21] Appl. No.: 493,370

[22] Filed: Jun. 21, 1995

[51] Int. Cl.[6] ..... B65D 23/08

[52] U.S. Cl. ..... 220/739; 720/903

[58] Field of Search ..... 206/427, 428, 206/429, 430; 220/903, 737, 739; 428/36.1, 36.2, 36.5, 36.6, 286, 287, 920

[56] References Cited

U.S. PATENT DOCUMENTS

| | | | |
|---|---|---|---|
| 3,578,199 | 5/1971 | Duncan | 220/739 X |
| 4,197,890 | 4/1980 | Simko | 220/903 X |
| 4,871,597 | 10/1989 | Hobson | 220/903 X |
| 5,147,079 | 9/1992 | Heather | 220/737 X |
| 5,261,554 | 11/1993 | Forbes | 220/739 X |
| 5,335,809 | 8/1994 | Toida et al. | 220/903 X |

*Primary Examiner*—Jacob K. Ackun

[57] ABSTRACT

A bottle holder holds a bottle having a perimeter, a height, a top, and a bottom. The bottle has a cylindrical body having a first end and a second end. The bottom is attached to the first end to create an interior volume. A neck with an opening is attached to the second end of the cylindrical body to create the opening connecting the interior volume to a volume exterior to the bottle. A first material is adapted to be extended substantially around the perimeter of the bottle to form a seam. The first material also extends substantially from the bottom of the bottle to the top of the bottle. The seam extends longitudinally approximately from the bottom of the bottle to the top of the bottle. A second material is attached to the first material that covers the bottom of the bottle. An apparatus, such a zipper, snaps, buttons, and velcro, is positioned along the seam to selectably close the seam to hold said bottle in place.

27 Claims, 10 Drawing Sheets

BOTTLE/CONTAINER HOLDER FOR TRANSPORTING THE BOTTLE/CONTAINER

PARTIAL WAIVER OF COPYRIGHT
PURSUANT TO 1077 O.G. 22(Mar. 20, 1987)

©Copyright, BrrrBag Products Limited U.S.A., Inc. 1995. All of the material in this patent application is subject to copyright protection under the copyright laws of the United States and of other countries. As of the first effective filing date of the present application, this material is protected as unpublished material.

However, permission to copy this material is hereby granted to the extent that the owner of the copyright and maskwork rights has no objection to the facsimile reproduction by anyone of the patent document or patent disclosure, as it appears in the United States Patent and Trademark Office patent file or records, but otherwise reserves all copyright rights whatsoever.

FIELD OF INVENTION

The present invention relates generally to bottle/container holders and the various manufacturing methods used to manufacture bottle/container holders and, more particularly, but not by way of limitation, relates to mechanical devices used to carry water bottles.

BACKGROUND

Water bottles, soda bottles, and even tea bottles are quite prevalent in today's culture, partly because of the nature of acceptance of bottled beverages in the marketplace in recent years combined with the increased interest in health and fitness. Bottles are used to hold a wide variety of fluids that may or may not be consumed by people, such as alcoholic beverages (e.g., wine, champagne), water, soft drinks, tea, etc. In addition, as the exercise and fitness craze has swept America, so has bottled water and similar fitness drinks (e.g., Gatorade™). Americans are often taking their drinks with them skiing, to the lake, to the beach, to the park, on hiking trips, etc. Consequently, there is a need for devices used to carry the bottles of fluids and for devices that transport the bottled water in an efficient and easy manner. There is also the need to preserve the temperature of the fluids in the bottles.

SUMMARY

The present invention provides a mechanical apparatus for holding, storing, and carrying bottles and a method of manufacturing mechanical apparatus for holding, storing, and carrying bottles.

Preferred mechanical apparatus for holding, storing, and carrying bottles hold a bottle having a perimeter, a height, a top, and a bottom, the bottle also having a body (e.g., cylindrical) having a first end and a second end. Regarding the bottle, the bottom of the bottle is attached to the first end of the body to create an interior volume. A neck with, an opening is attached to the second end of the body to create an opening connecting the interior volume to a volume exterior to the bottle. Preferred holders comprise a first material, a second material, and an apparatus to selectably close a seam created by the first material (e.g., zipper, velcro, etc.). The first material is adapted to be extended substantially around the perimeter of the bottle to form a first seam. The first material also extends substantially from the bottom of the bottle to the top of the bottle. The first seam extending longitudinally approximately from the bottom of the bottle to the top of the bottle. A second material is attached to the first material that covers the bottom of the bottle. An apparatus is positioned along the first seam to selectably close the first seam to hold the bottle in place. If a zipper is used to close the seam, the zipper has a first set of teeth positioned on one side of the seam and a second set of teeth positioned on another side of the seam, and a sliding body to interlock the first set of teeth and the second set of teeth. Preferred embodiments also have at least one reinforcement strap attached to the first material that is also extending around the perimeter of the cylindrical body of the body to reinforce the bottle holder. Another strap is formed by attaching a first end and a second end to the first material to form a loop. In addition, preferred embodiment may also comprise a buckle having a plurality of lateral openings therein and a first strap having a first end and a second end, looped strap having a first end and a second end, the first end attached to the first material and a second strap having a first end and a second end, the first end attached to the first material. The first end and the second end is attached to and extending from first material to form a strap. The second end of the first strap extends through one lateral opening of the plurality of lateral openings, the second end of the second strap extending through one lateral opening of the plurality of lateral openings. Preferred embodiment also uses first material having an inner lining that insulates the bottle to keep substances in the bottle at a constant temperature. Linings in preferred embodiments use Thermolyte™, which is an extremely thin and lightweight insulator manufactured by Dupont Corporation that keeps the bottle and substances contained therein warm and keeps the bottle and substances contained therein cold. Preferred embodiments also have a loop and mechanical hook hooked thereto, which provides a holding apparatus to attach keys, trinkets, and the like thereto. A pocket can also be formed from material (e.g., nylon) and stitched to the side of the first outer coating material along with a securing apparatus, such as a snap or velcro, to selectively secure the opening of the pocket closed.

Preferred mechanical apparatus offers a number of advantages. They provide a means to keep the substances contained by the bottle or similar container at a constant temperature, regardless of whether the starting temperature is warm or cold. This provides an easy and efficient mechanism to tote or carry bottled substances. Similarly, preferred embodiments provide easy access to remove and replace empty bottles from the container that holds the bottles. Preferred embodiments have a strap extending around the outside of the bottle to reinforce the container and a strap with an adjustable buckle to allow the user to carry the bottle held by the container over their shoulder, by hand, attached to a back pack, or to a bike, etc. They also have an additional looped strap that allows the user to carry the bottle held by the container with a finger and/or to hold a bottle upside down, or to attach a key ring to it, etc. The preferred holder is also positioned farther up the bottle, closer to the end to insulate significantly larger portions of the bottled water. Finally, use of the seam and the apparatus to selectably close the seam (e.g., zipper) enables the bottle holder to easily adjust to different size bottles and containers. The apparatus effectively takes up the slack or loosens up the seam to enable larger bottles and containers to fit. The overall container provides a sheath in which to hold the bottle. In short, preferred embodiments serve all of the functions of preservation of coolness, convenience, and toteability.

Preferred methods of manufacturing a bottle holder for a cylindrical bottle having a height and perimeter, generally comprise the following steps: (a) looping first strapping material through one lateral opening of a buckle, the buckle having three lateral openings substantially parallel to one another; (b) single needling second strapping material to first outer coating material to attaching the first strapping material and the buckle and third strapping material strapping to the first outer coating material, the outer coating material having a length and width and being rectangular in shape, the length approximately equal to the height of the bottle and the width approximately equal to the perimeter of the bottle; (c) serging the second outer coating material to the first outer coating material; (d) serging seams of the second outer coating material up from the bottom; (e) attaching cording or plastic welting and a zipper to the edges of the longitudinal opening in the first outer coating material, and (f) attaching/stitching strapping to the first material to form a loop. Preferred processes also comprise the additional step of (g) attaching an additional loop (e.g., nylon) and snaphook to hold keys, trinkets, and the like. The additional step of adding a pocket formed from material (e.g., nylon), which is stitched to the side of the first outer coating material. A securing apparatus, such as a snap or velcro, secures the opening of the pocket closed.

Preferred methods provide a number of advantages. In particular, the preferred steps offer a minimalist approach to manufacturing the preferred embodiments, which can be performed in a minimal amount of time with very little effort. Preferred manufacturing methods also use a minimal amount of material. In addition, certain steps can be automated, which reduces the manufacturing time and cost further.

The disclosed systems and methods work on a wide variety of bottles or containers that are used to carry a large amount of liquid substances. For instance, different sizes of the preferred embodiment can be adapted to carry all sorts of bottles of different sizes and shapes (e.g., 1 liter bottle, 12 ounce bottle, water bottle, Coke™ bottle) that are comprised of different materials (e.g., plastic, metal, or glass). Similarly, the fluids contained by the container include soft drinks, health drinks, water, alcoholic beverages, etc.

BRIEF DESCRIPTION OF THE DRAWINGS

Further features and advantages will become apparent from the following and more particular description of the various embodiments of the invention, as illustrated in the accompanying drawings, wherein.

DETAILED DESCRIPTION OF THE PREFERRED EMBODIMENTS

Figure 1A:
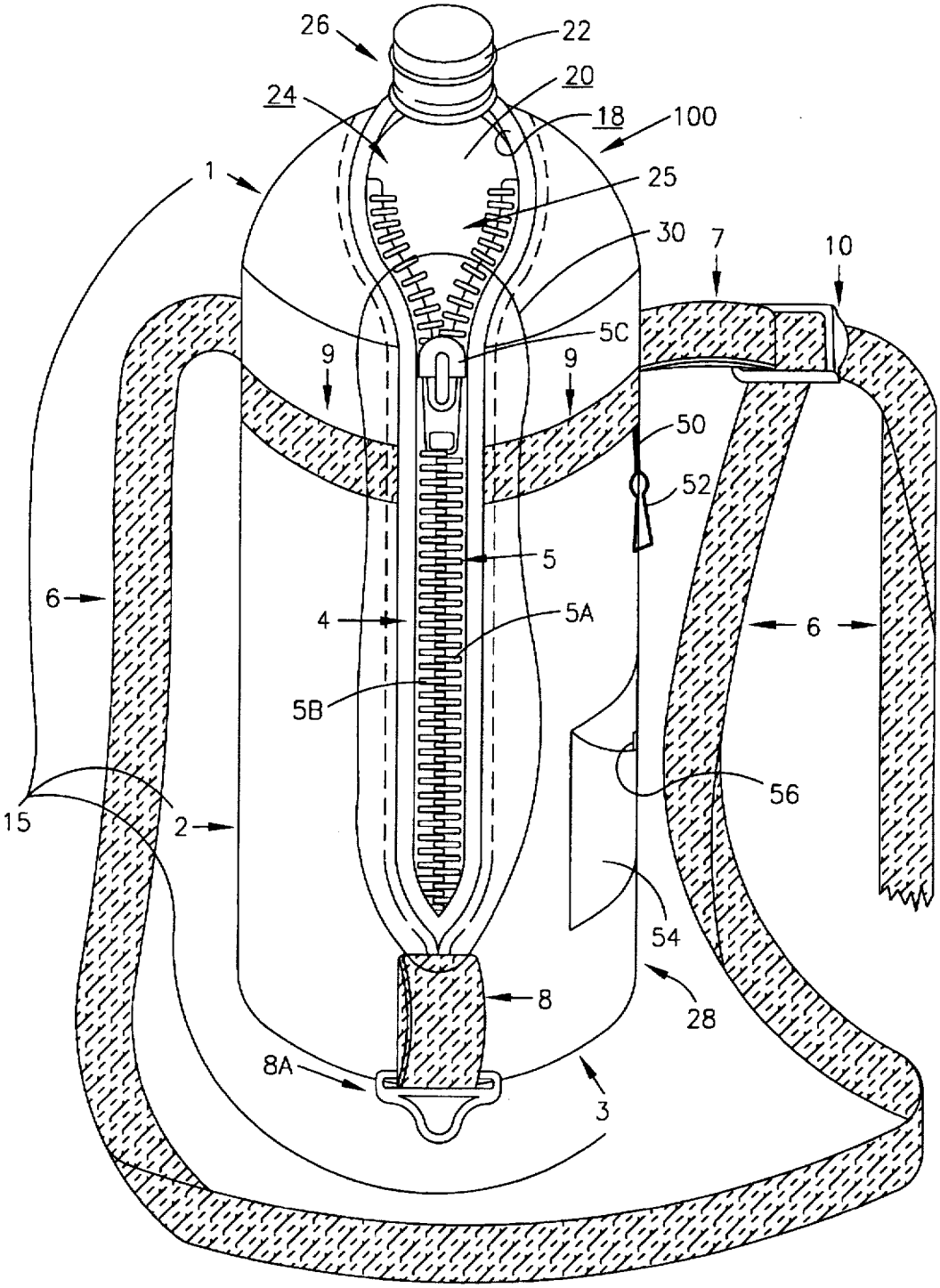
FIG. 1A is a perspective view of a preferred embodiment of the bottle/container holder 100.
Figure 1B:
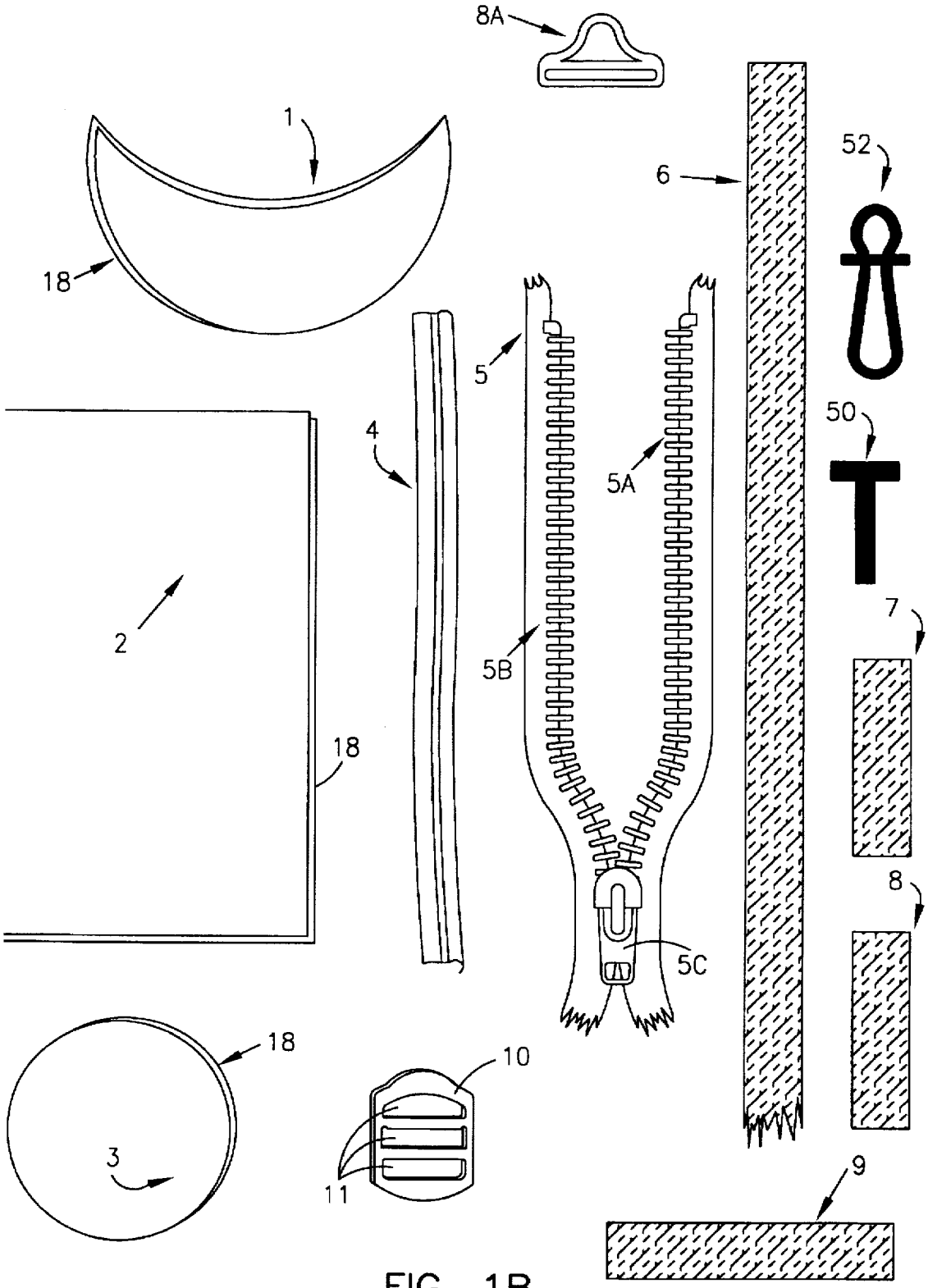
FIG. 1B shows various pieces that are preferably combined to form bottle/container holder 100 shown in FIG. 1A.

FIG. 1A is a perspective view of a preferred embodiment of the bottle/container holder 100, which comprises bottle 20, first straps 6, second strapping material 7, third strapping material 8, fourth strapping material 9, zipper 5, plastic welting 4, buckle 10, inner lining 60, outer coating material 1, 2, and 3. FIG. 1B shows various pieces that are preferably combined to form bottle/container holder 100 shown in FIG. 1A. Bottle/container holder 100 holds bottle 20 therein. Bottle (or container) 20 preferably holds a liquid 24 or other substance inside an interior volume 25. Bottle 20 may range in size (e.g., 1 liter, 1.5 liter, and 0.5 liter). Bottle (or container) 20 has a threaded opening at first end 26 of bottle 20 and a cap 22 removably attached (screwed in) at first end 26. Second end 28 of bottle 20 is placed inside a pocket created inside bottle/container holder 100. The pocket is created by assembling wrapping outer coating material 1, 2, and 3 (shown independently in FIG. 1B) together into a single unit 15 having first seam 30 extending longitudinally down one side of bottle 20, as shown in FIG. 1A. The pocket is cylindrical in shape to hold a typical bottle used to hold soft drinks, alcoholic beverages, tea, water, etc. First seam 30 can be opened or unzipped (as shown in the preferred embodiment shown in FIG. 1A) to make inserting bottle 20 into the pocket created by assembling wrapping outer coating easier. The pocket created by outer coating material 1, 2, and 3 effectively forms a sheath in which to place a bottle 20. While the dimensions of preferred embodiments may vary, depending upon the size of the bottle inserted therein, preferred embodiments generally use a zipper that stops approximately 2 inches up from the bottom of bottle 20 (the second end 28 of bottle 20 inserted in the pocket), but may actually extend the length of bottle 20. Fourth strapping material 9 is preferably attached (glued, stitched, etc.) to the outside of the coating material and provides additional support for the overall bottle/container holder 100, which increases the overall integrity of the bag. Fourth strapping material 9 is preferably placed toward the first end 26. Preferred embodiments of the bottle/container holder 100 also have loop 50 and mechanical hook 52 hooked thereto, which provides a holding apparatus (e.g., snap hook) to attach keys, trinkets, and the like thereto. Preferred embodiments of bottle/container holder 100 also have an outer pocket 54 formed from material (e.g., nylon), which is stitched to the side of the first outer coating material 2 along with a securing apparatus 56, such as a snap button or velcro, to selectively secure the opening of the outer pocket 54 closed.

Figure 1D:
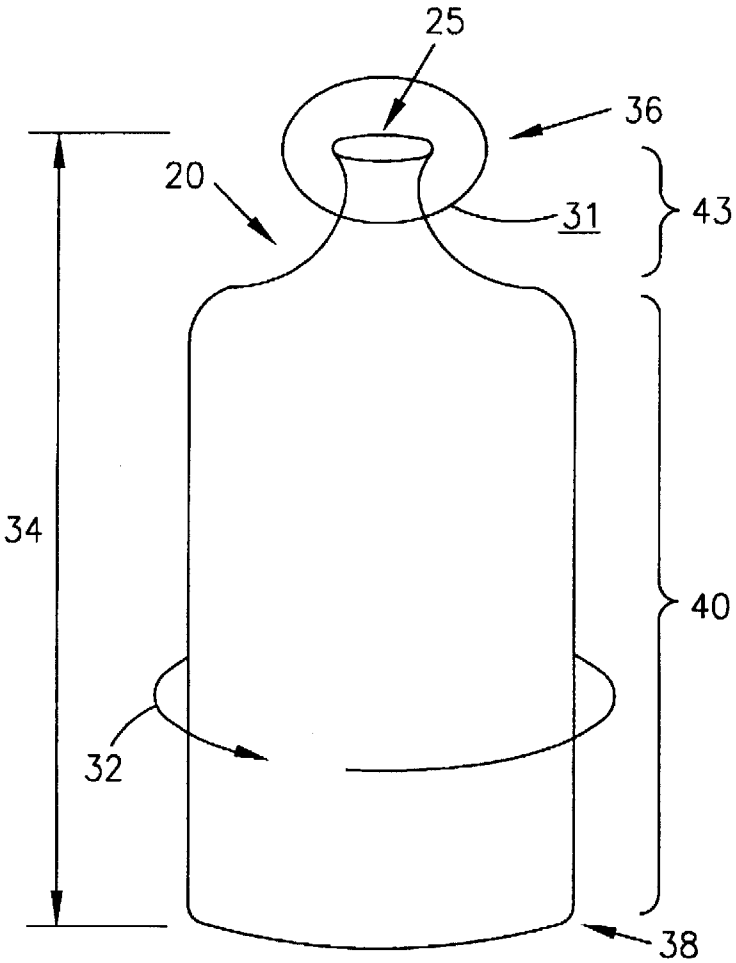
FIGS. 1C and 1D show a variety of bottle shapes and sizes that bottle/container holder 100 can hold.
Figure 1C:
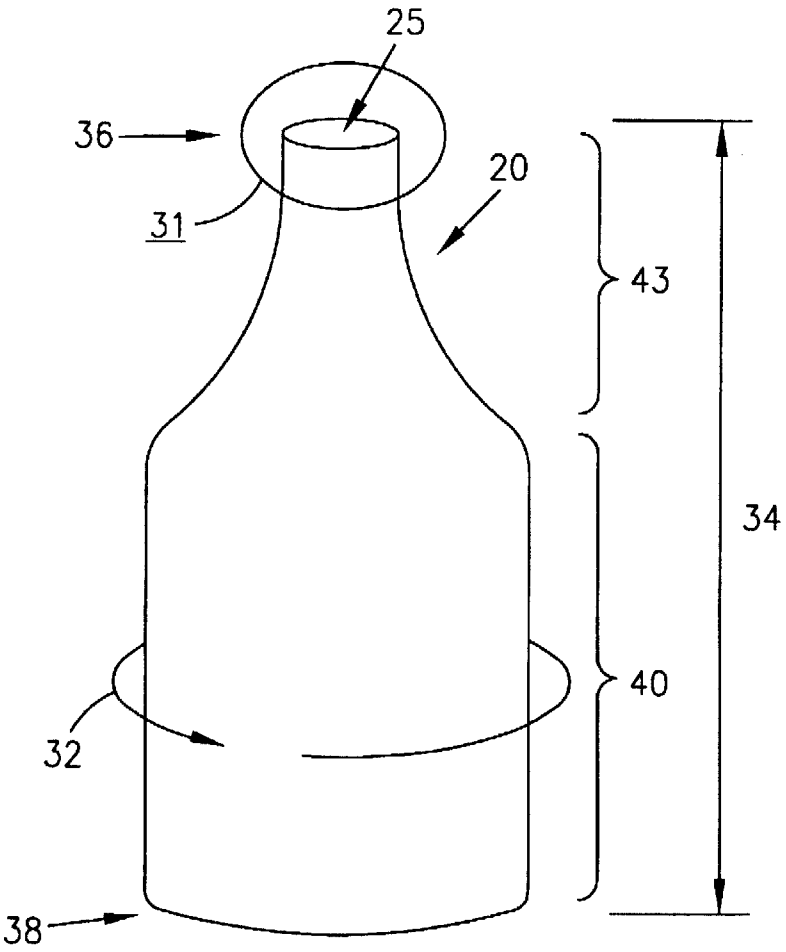

As shown in FIGS. 1C and 1D, bottle 20 has perimeter 32, height 34, top 36, and bottom 38. An opening 31 is positioned generally at the top 36 of bottle 20 to pour liquid substances housed in interior volume 25 by bottle 20 therefrom. Bottle 20 also has a cylindrical body 40, which is generally cylindrical, and a neck 43. Cylindrical body 40 has first end 26 and second end 28. Bottom 38 is attached to the first end 26 of cylindrical body 40 to create an interior volume 25. Neck 43 is attached to second end 28 of body 40 and has an opening 31 therein that links or connects interior volume 25 to a volume exterior to bottle 20. Neck 43 generally assumes the shape of a hollow cone that has an apex and a base. The perimeter 32 of the base of conical neck 43 is attached to perimeter 32 of second end 28 of body 40. FIG. 1D shows a bottle having a very small neck 43 (if one at all) that is not conical. Bottle 20 may also assume the shape of a cylindrical can that does not have any neck. Opening 31 is positioned in the apex of hollow cone. Note there is a large variety of body shapes and sizes, so the dimensions may change. Similarly, there is a large variety of materials that the bottles may be comprised, such as plastic and glass, so the particular material composition of each bottle may change, as will the fragility of the bottle itself.

Fourth strapping material 9 may also be attached to or extended by first strap 6 and second strapping material 7 to provide an extended strap or shoulder harness. Buckle 10 functions as a draw-string. As explained below, second strapping material 7 is looped through two openings of opening 31 of buckle 10 (in FIG. 1B) to hold buckle 10 in place. Similarly, ends of first strap 6 and second strapping material 7 are mechanically coupled together with buckle 10. An end of first strap 6 that is not attached to container is also inserted through holes 11 of buckle 10. Buckle 10 makes the shoulder harness adjustable. Buckles and attachment fixtures of preferred embodiments, such as buckle 10, which is a ladder buckle, buckle 8A, which is a double D ring buckle, loop 50, and mechanical hook 52, are manufactured by National Webbing Products Co., 77 Second Ave., Garden City Park, N.Y. 11040. Alternative buckles may be used as well, such as those described in the catelog or listing of buckles manufactured by National Webbing Products Co., which is herein incorporated by reference.

Furthermore, plastic welting 4 and zipper 5 are combined together to provide selectably close first seam 30. As described above, alternate apparatus may be used that open and close first seam 30 before and after a bottle 20 is inserted therein, such as buttons, plastic zippers, velcro, etc. Use of first seam 30 enables the overall bottle/container holder 100 to be adjustable, which enables it to act as a sheath for a variety of bottle sizes and shapes. As long as the width (or diameter) of bottom 38 of bottle 20 is smaller than bottom 38 of bottle/container holder 100, so that it will fit, zipper 5 can be pulled up to the desired height to enclose as much of bottle 20 as possible. By analogy, the use of the zipper 5 in the preferred embodiment effectively functions to zip up a hot dog in a bun. Preferred embodiments of the zipper 5 have a first set of teeth 5A positioned on one side of first seam 30 and a second set of teeth 5B positioned on another side of first seam 30 and a sliding body 5C to interlock first set of teeth 5A and second set of teeth 5B together. Zipper 5 is preferably comprised largely of plastic, which does not rust. Alternate apparatus, such as buttons, velcro, hooks, and snaps, can be used in place of zipper 5. Zipper 5 is preferred, because it enhances the insulation of the bottle 20 and the substance (e.g., fluid) contained therein by assuring maximum air tightness.

Outer coating material 1, 2, and 3 are comprised preferably of an inner insulating lining 18, which is preferably comprised of a material manufactured by Hobbs Fiber, who manufactures fiber insulating material for DuPont: Thermolyte™. While Thermolyte™ is typically advertized as an insulating material to keep substances warm, the applicants have discovered that it also keeps substances cool. Thermolyte™ also has the added advantage of being light-weight and having uniform loft. The inner insulating lining 18 has the added advantage of cushioning the bottle 20. The inner insulating lining 18, particularly when comprised of Thermolyte™, keeps perspiration from bottle 20 (e.g., water) in place between the bottle 20 and inner insulating lining 18 and does not absorb or otherwise transfer the perspiration away from the bottle 20 in the inner insulating lining 18 into the outer fabric, which further enhances the insulation of bottle 20. While inner insulating lining 18 may be enclosed by an inner shell (not shown), inner insulating lining 18 of preferred embodiments is preferably in contact with bottle 20. It is important that the loft of inner insulating lining 18 be full and even throughout the product to assure circulation for superior effectiveness of long term temperature control—to crush the fiber would eliminate the insulating abilities. Thus, it is important that the overall nature of container/bottle holder 100 facilitate the maintenance of full and even loft of inner insulating material 18. A resin (not shown) preferably covers the inner insulating lining 18 and creates an invisible soft shell, which prevents it from pulling or piling up. The outside fabric is UV repellant and generally comprises of a polyurethane coated material and nylon.

When out coating material 1 is attached correctly, coating material extends up the length of bottle 20 toward first end 26. This has the advantage of covering more of bottle 20 to insulate it, as well as keeping bottle 20 firmly positioned inside the pocket, even when the bottle 20 is turned upside down.

Consequently, preferred embodiments provide a universal design that could encase the various sizes of bottled beverages on the market today. Preferred embodiments effectively serve as a personal carryall for any number of personal items (e.g., keys, money, license, credit cards, etc.) for an individual with an active lifestyle in which a purse would be an inconvenience.

Figure 2:
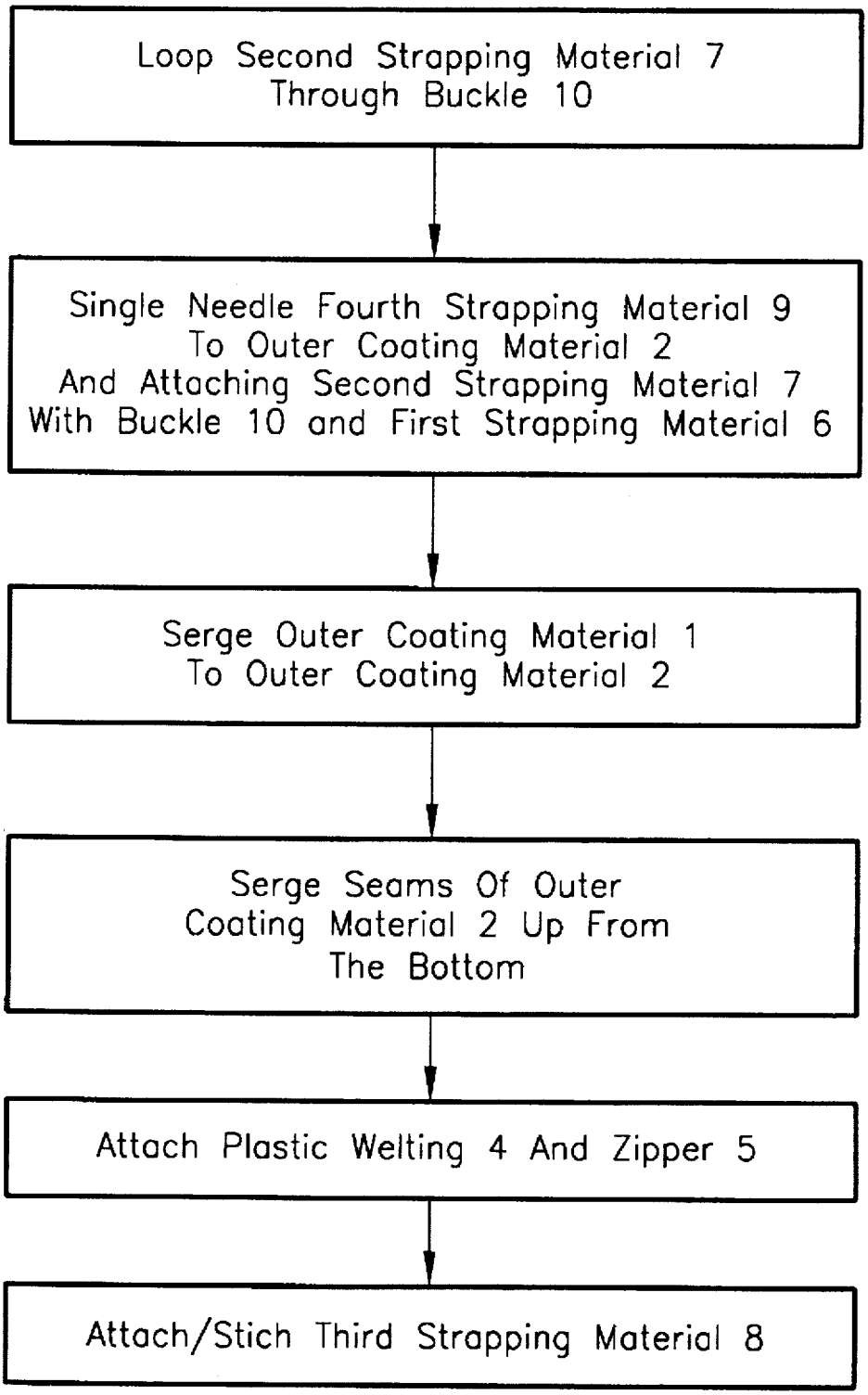
FIG. 2 is a flow chart showing the manufacturing steps used to manufacture the preferred embodiment shown in FIG. 1A from the pieces shown in FIG. 1B.
Figure 3A:
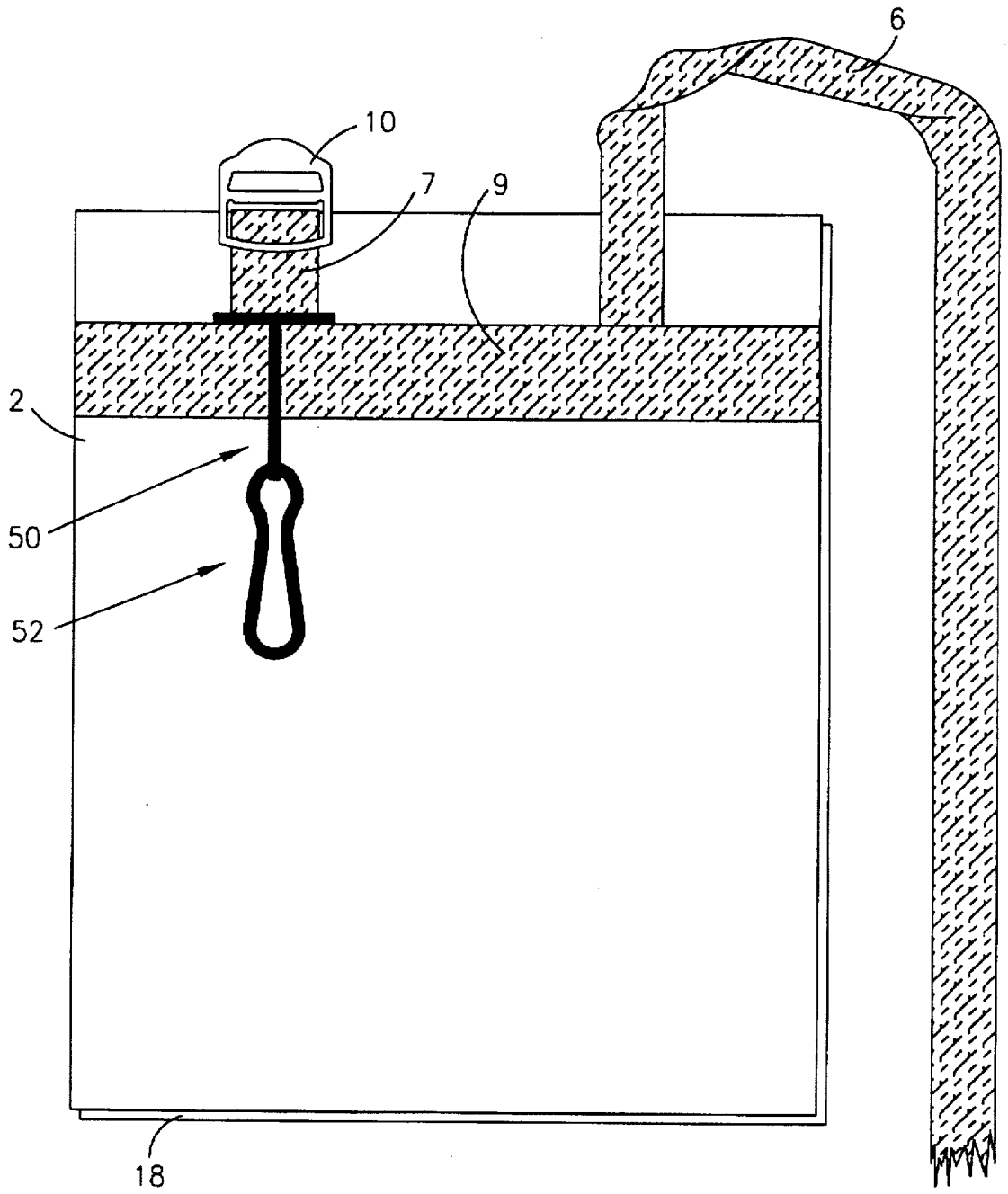
FIGS. 3A, 3B, 3C, 3D, 3E, and 3F are respective illustrations showing the steps used to manufacture the preferred embodiment shown in FIG. 1A from the pieces shown in FIG. 1B.
Figure 3B:
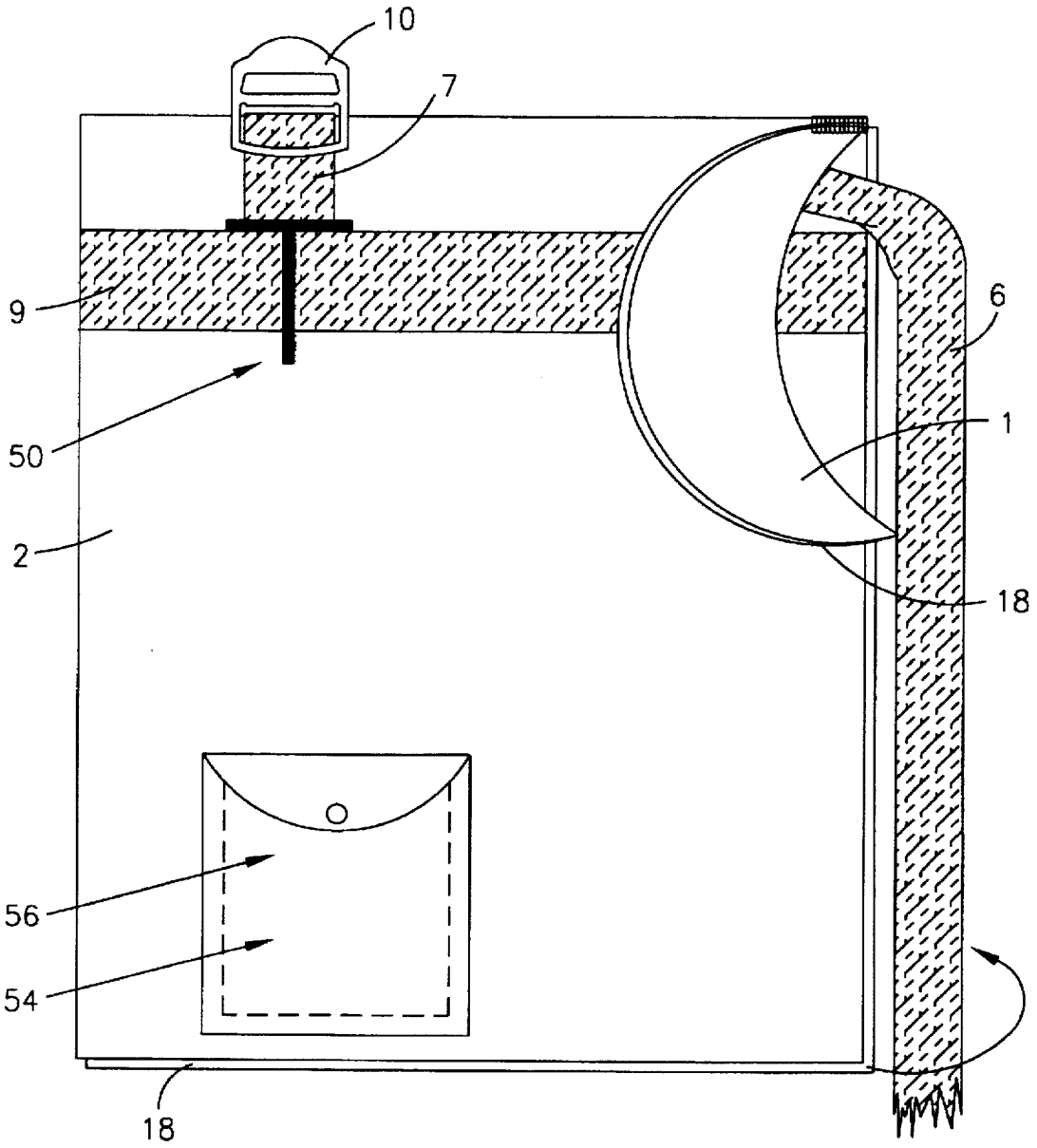
Figure 3C:
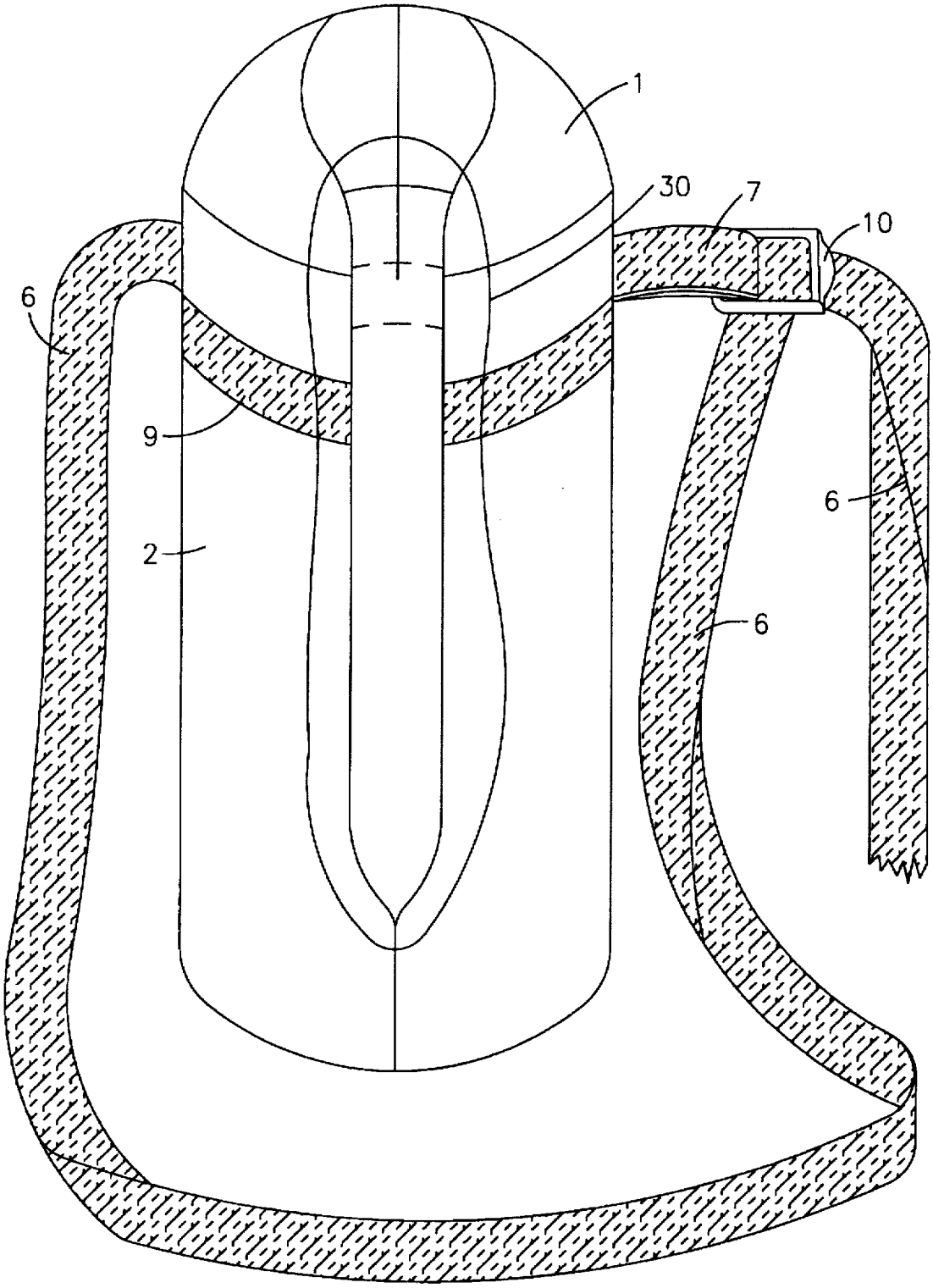
Figure 3D:
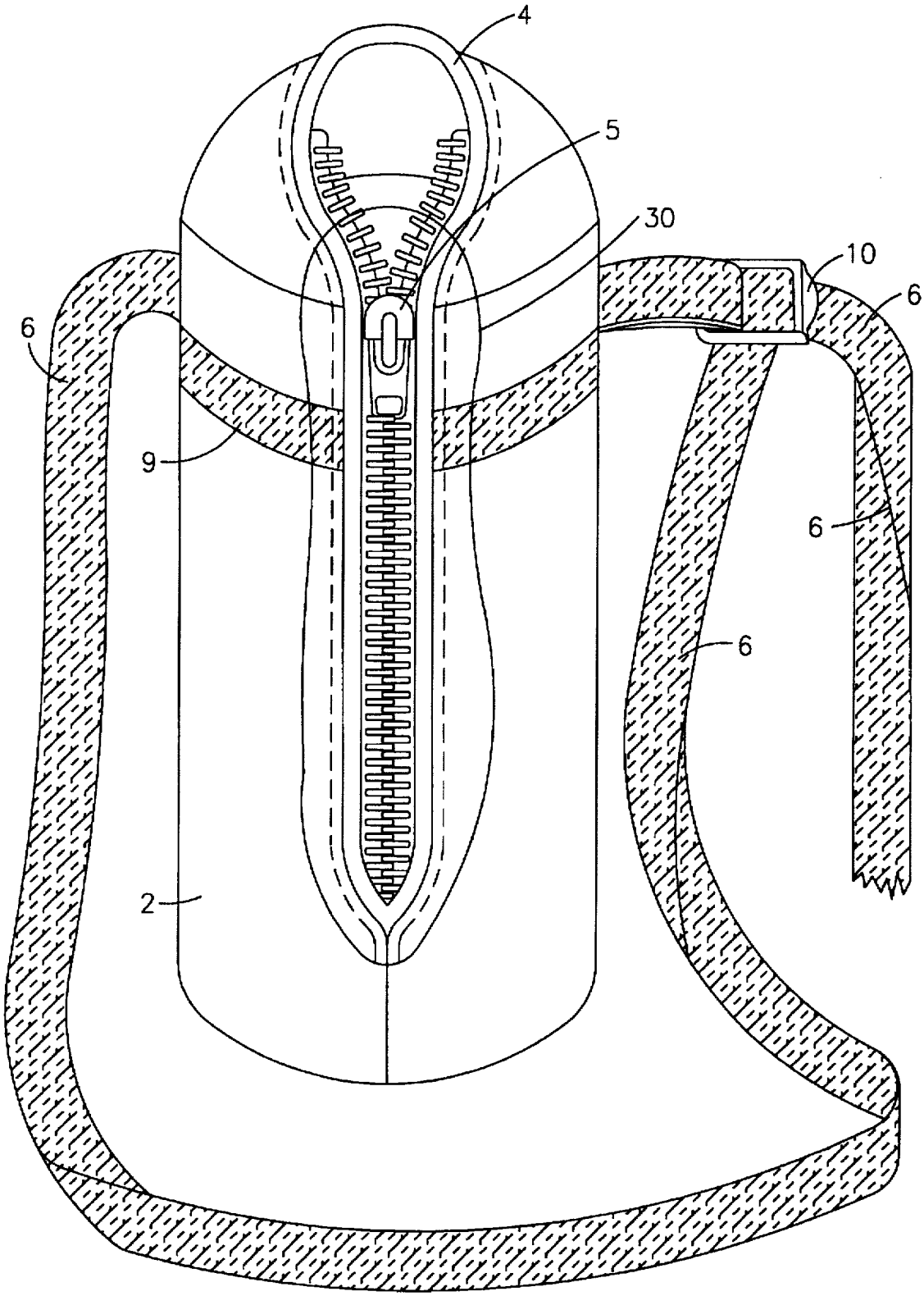
Figure 3E:
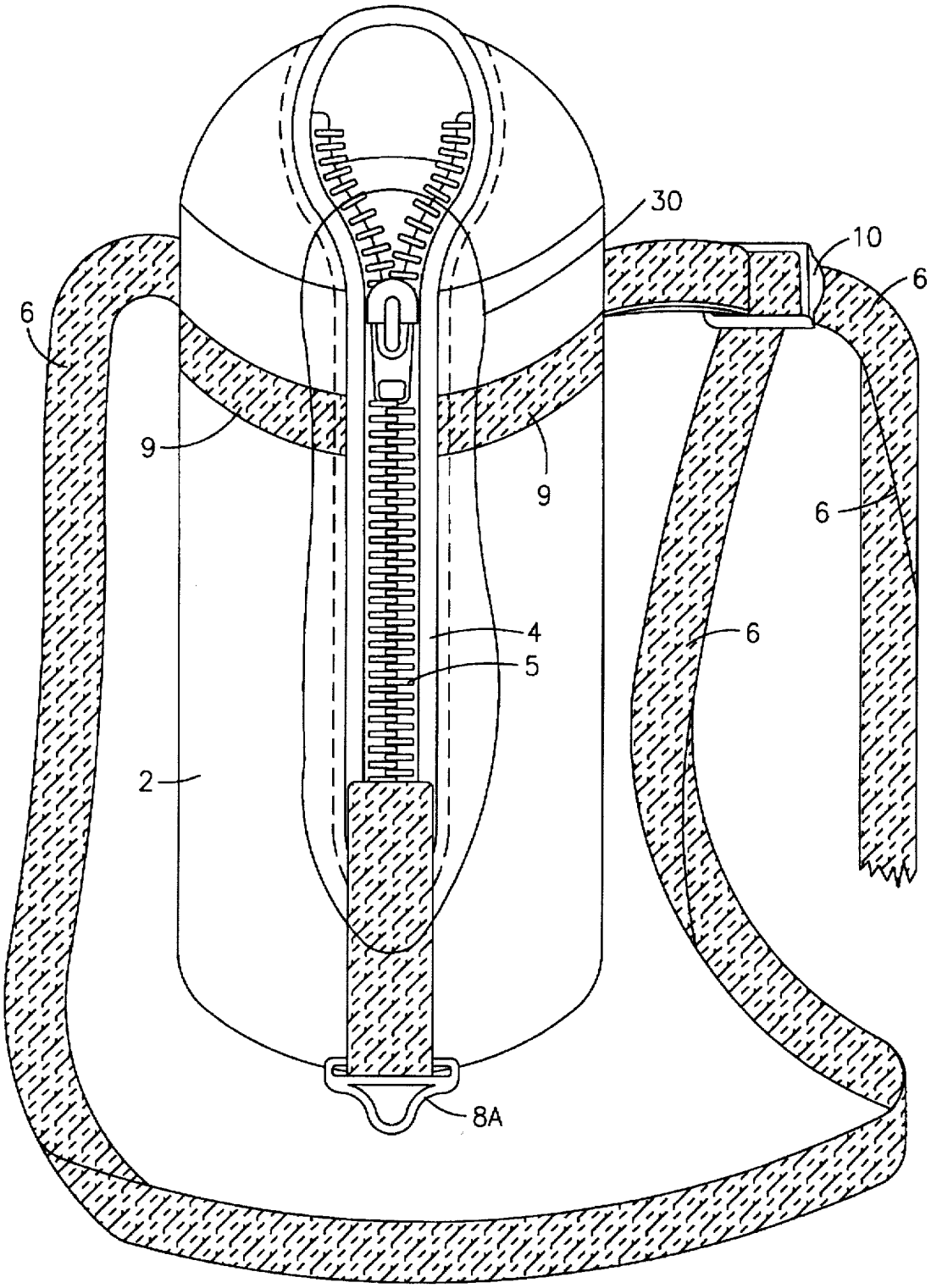
Figure 3F:
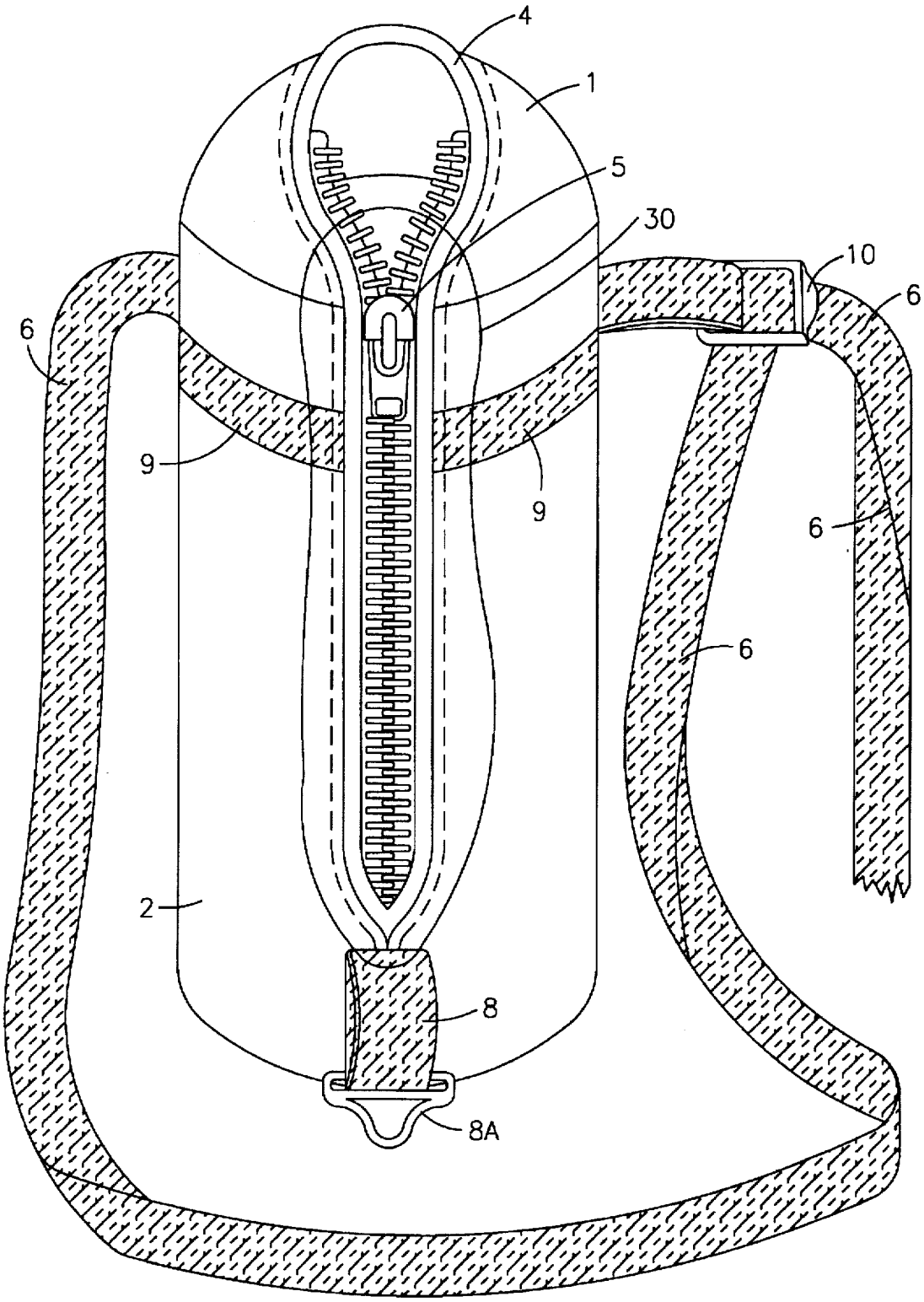

FIG. 2 is a flow chart showing the manufacturing steps used to manufacture the preferred embodiment shown in FIG. 1A from the pieces shown in FIG. 1B. FIGS. 3A, 3B, 3C, 3D, 3E, and 3F are respective illustrations showing the steps used to manufacture the preferred embodiment shown in FIG. 1A from the pieces shown in FIG. 1B. Preferred methods generally comprise the following steps: looping second strapping material 7 through buckle 10, single needle fourth strapping material 9 to outer coating material 2 and attaching second strapping material 7 with buckle 10 and first strap 6, serging outer coating material 1 to outer coating material 2, serging seams of outer coating material 2 up from bottom 38, attaching plastic welting 4 and zipper 5, and attaching/stitching third strapping material 8. Third strapping material 8, which is used to create a loop, can also be pulled through an opening in a double D ring buckle 8A to provide an additional buckle with which to attach and/or secure bottom portion of container/bottle holder 100 to another strap, another object, etc. Note spring steel wire can also be inserted in the plastic welting 4, which is hollow, to keep the bottle/container holder 100 to remain upright and open. In particular, as shown in FIG. 3A, the first step entails lopping second strapping material 7. Preferred processes also comprise the additional step of (g) attaching an additional loop (e.g., nylon) and snaphook to hold keys, trinkets, and the like. The additional step of adding a pocket formed from material (e.g., nylon), which is stitched to the side of the first outer coating material. A securing apparatus, such as a snap or velcro, secures the opening of the pocket closed. Note the sequences of steps can be changed as needed.

FURTHER MODIFICATIONS AND VARIATIONS

Although the invention has been described with reference to a specific embodiment, this description is not meant to be construed in a limiting sense. As described above, various modifications of the disclosed embodiment as well as alternate embodiments of the invention will become apparent to persons skilled in the art upon reference to the description of the invention. For instance, material used in preferred embodiments may use any variety of colors, textures, etc. Materials may be rubberized and/or waterproof. As described above, please note any number of accent features, such as webbing, outer shell materials, pocket feature, buckles, key clips, zippers, and welting could be added as well. Accordingly, it should be understood that the modifications and variations suggested above and below are not intended to be exhaustive. These examples help show the scope of the inventive concepts, which are covered in the appended claims. The appended claims are intended to cover these modifications and alternate embodiments. In particular, following the above teachings, other abrasive media could be used in addition to those specified above, depending upon the nature of the cleaning assignments. In addition, the processes and systems discussed above could be automated. Additional and existing straps can be dropped or added as needed for alternate embodiments, such as ones used with bicycles. Other man-made or natural fabrics can be used as well, such as leather, ostrich and tapestry.

What is claimed is:

1. A bottle holder having a bottle holder interior to hold a bottle having a cylindrical body having a first end and a second end and a perimeter, said first end of said cylindrical body is closed to create an interior volume and a neck is attached to said second end of said cylindrical body, said neck having an opening therethrough to connect said interior volume to a volume exterior to said bottle, comprising:

(a) a first material adapted to be extended substantially around said perimeter of said cylindrical body of said bottle to form a seam, said first material also extending substantially from said first end of said cylindrical body to said opening in said neck attached to said second end of said cylindrical body, so that said first material substantially covers said cylindrical body and said neck, said seam extending longitudinally approximately from said first end of said cylindrical body to said opening in said neck, said first material comprised of a polyurethane coated material and nylon and having an internal surface facing toward said bottle when said bottle is positioned inside said bottle holder;

(b) a second material attached to said first material that covers said first end of said cylindrical body of said bottle;

(c) an apparatus positioned along said seam to selectably close said seam to hold said bottle in place when said bottle is positioned inside said bottle holder; and (d) an insulating material affixed to said first material and positioned between said internal surface and said bottle when said bottle is positioned inside said bottle holder, said insulating material in physical contact with said bottle when said bottle is positioned inside said bottle holder, said insulating material comprised of Thermolyte, wherein said first material, said second material, said apparatus, and said insulating material combine to form said bottle holder interior, and further wherein said first material and said bottle holder interior are only separated by said insulating material.

2. The bottle holder of claim 1, wherein said first material has a first edge and a second edge, said first edge and said second edge form said seam, further wherein said apparatus is a zipper having a first set of teeth positioned on said first edge of said seam and a second set of teeth positioned on said second edge of said seam, and a sliding body to interlock said first set of teeth and said second set of teeth.

3. The bottle holder of claim 1, further comprising a piece of fabric having a perimeter, wherein said first material has an outer surface to which said piece of fabric is attached along a portion of said perimeter to create a pocket.

4. The bottle holder of claim 1, wherein said first material has an outer surface, and further comprising at least one reinforcement strap extending around and affixed to said outer surface such that said at least one reinforcement strap also extends around said perimeter of said cylindrical body of said bottle when said bottle is positioned inside said bottle holder.

5. The bottle holder of claim 1, further comprising a looped strap having a first loop end and a second loop end, said first loop end of said looped strap and said second loop end of said looped strap attached to and extending from said first material.

6. The bottle holder of claim 1, further comprising (e) a buckle having a plurality of lateral openings therein;

(f) a first strap having a first strap end and a second strap end, said first strap end of said first strap attached to said first material;

(g) a second strap having a third strap end and a fourth strap end, said third strap end of said second strap attached to said first material;

said first strap end and said second strap end attached to and extending from said first material; and said second strap end of said first strap extending through one lateral opening of said plurality of lateral openings, said third strap end of said second strap extending through said one lateral opening of said plurality of lateral openings of said buckle, such that said buckle selectably joins said first strap with said second strap.

7. The bottle holder of claim 1, wherein said insulating material keeps substances in said bottle at a constant temperature.

8. The bottle holder of claim 1, further wherein said second material has a loop affixed thereto, said loop having an opening, said bottle holder further comprising a snaphook extending through said opening.

9. The bottle holder of claim 1, wherein said first material is also UV repellant.

10. The bottle holder of claim 1, wherein said bottle is comprised of a bottle material selected from a group consisting of plastic, metal, and glass.

11. The bottle holder of claim 1, wherein said first material and said second material are also comprised of leather, ostrich and tapestry.

12. The bottle holder of claim 1, wherein said first material is water proof.

13. The bottle holder of claim 1, wherein said first material has a first edge and a second edge, said first edge and said second edge form said seam and said apparatus is selected from a group consisting of buttons and Velcro.

14. The bottle holder of claim 1, wherein said first material and said insulating material are joined together along said seam by plastic welting.

15. A container having a container interior to hold a bottle, said bottle having a first bottle end, a second bottle end, and a perimeter surface, comprising:

(a) a polyurethane coated, nylon layer substantially covering said first bottle end of said bottle and said perimeter surface of said bottle, said polyurethane coated, nylon layer having a first layer end and a second layer end, said polyurethane coated, nylon layer extending substantially around said perimeter surface of said bottle, said first layer end and said second layer end combine to form a seam, said seam extending longitudinally along said bottle approximately from said bottom of said bottle to said top of said bottle, said polyurethane coated, nylon layer having an internal surface facing substantially toward said bottle;

(b) an insulating layer substantially covering said first bottle end of said bottle and said perimeter surface of said bottle, said polyurethane coated, nylon layer having a first insulating layer end and a second insulating layer end, said insulating layer extending substantially around said perimeter surface of said bottle, said first insulating layer end secured to said polyurethane coated, nylon layer end and said second insulating layer end secured to said second layer end which combine to form a seam, said insulating layer comprised of Thermolyte; and (c) an apparatus positioned along said seam to selectably close said seam to hold said bottle in place, wherein said polyurethane coated, nylon layer, said insulating layer, and said apparatus combine to form said container interior and further wherein said polyurethane coated, nylon layer is only separated from said container interior substantially by said insulating layer.

16. The container of claim 15, wherein said polyurethane coated, nylon layer end and said first insulating end are secured together by welting and wherein said second layer end and said insulating end are secured together by welting.

17. The container of claim 15, wherein said apparatus is a zipper having a first set of teeth secured to one side of said seam and a second set of teeth secured to another side of said seam, and a sliding body to interlock said first set of teeth and said second set of teeth.

18. The container of claim 15, further comprising a piece of fabric having a perimeter, wherein said polyurethane coated, nylon layer has an outer surface to which said piece of fabric is attached along a portion of said perimeter to create a pocket.

19. The container of claim 15, wherein said bottle has a cylindrical body, and wherein said polyurethane coated, nylon layer has an outer surface, and further comprising at least one reinforcement strap extending around and affixed to said outer surface such that said at least one reinforcement strap also extends around said perimeter of said cylindrical body of said bottle when said bottle is positioned inside said bottle holder.

20. The container of claim 15, further comprising a looped strap having a first end and a second end, said first end of said looped strap and said second end of said looped strap attached to and extending from said polyurethane coated, nylon layer.

21. The container of claim 15, further comprising (d) a buckle having a plurality of lateral openings therein;

(e) a first strap having a first strap end and a second strap end, said first strap end of said first strap attached to said first material;

(f) a second strap having a third strap end and a fourth strap end, said third strap end of said second strap attached to said first material;

said first strap end and said second strap end attached to and extending from said first material to form a carrying strap; and said second strap end of said first strap extending through one lateral opening of said plurality of lateral openings, said third strap end of said second strap extending through said one lateral opening of said plurality of lateral openings of said buckle.

22. A light-weight insulating enclosure having an interior to hold a container, said container having a container opening through which substances can flow from said container, comprising:

(a) a polyurethane coated, nylon layer and a insulating layer substantially surrounding said container, said polyurethane coated, nylon layer and said insulating layer combined to form an enclosure opening for receiving and removing said container when fully opened and for permitting access to said container opening to permit said substances to flow to and from said container, while being insulated by said light-weight, insulating enclosure, said insulating layer comprised substantially of Thermolyte, said polyurethane coated, nylon layer and said insulating layer combine to form a single layer in which said polyurethane coated, nylon layer and said interior are only separated by said insulating layer; and (b) an apparatus positioned substantially along said enclosure opening to selectively and substantially close enclosure opening to secure and insulate said container and to permit said substances to flow to and from said container through said container opening.

23. The light-weight insulating enclosure of claim 22, wherein apparatus is selected from a group consisting of bottoms, Velcro, and a zipper.

24. The light-weight insulating enclosure of claim 22, wherein said enclosure opening has a first opening edge and a second opening edge which when placed along side one another form a seam, further wherein said apparatus is a zipper having a first set of teeth secured to and substantially along said first opening edge of said seam and a second set of teeth secured to and substantially along said second opening edge of said seam, and a sliding body to interlock said first set of teeth and said second set of teeth.

25. The light-weight insulating enclosure of claim 22, further comprising a piece of fabric having a perimeter, wherein said polyurethane coated, nylon layer has an outer surface to which said piece of fabric is attached along a portion of said perimeter to create a pocket.

26. The light-weight insulating enclosure of claim 22, wherein said polyurethane coated, nylon layer has an outer surface, and further comprising at least one reinforcement strap extending around and affixed to said outer surface such that said at least one reinforcement strap also extends round said container when said container is positioned inside said light-weight insulating enclosure.

27. The light-weight insulating enclosure of claim 22, further comprising a looped strap having a first end and a second end, said first end of said looped strap and said second end of said looped strap attached to and extending from said polyurethane coated, nylon layer.

* * * * *